United States Patent [19]

Matsuta et al.

[11] Patent Number: 4,757,321

[45] Date of Patent: Jul. 12, 1988

[54] ANTENNA TERMINAL BOARD DEVICE FOR TUNER

[75] Inventors: Shigetoshi Matsuta; Tetsurou Umemoto, both of Soma, Japan

[73] Assignee: Alps Electric Co., Ltd., Japan

[21] Appl. No.: 799,017

[22] Filed: Nov. 18, 1985

[30] Foreign Application Priority Data

| | | | |
|---|---|---|---|
| Nov. 19, 1984 | [JP] | Japan | 59-174328 |
| Nov. 19, 1984 | [JP] | Japan | 59-174334 |
| Nov. 24, 1984 | [JP] | Japan | 59-178415 |
| Nov. 24, 1984 | [JP] | Japan | 59-178416 |
| Nov. 24, 1984 | [JP] | Japan | 59-178417 |

[51] Int. Cl.[4] ..... H01Q 1/24

[52] U.S. Cl. ..... 343/702; 343/872

[58] Field of Search ..... 343/702, 872

[56] References Cited

U.S. PATENT DOCUMENTS

| | | | |
|---|---|---|---|
| 3,965,474 | 6/1976 | Guerrino et al. | 343/872 |
| 4,455,682 | 6/1984 | Masters | 343/702 |

*Primary Examiner*—William L. Sikes

*Assistant Examiner*—Robert E. Wise

*Attorney, Agent, or Firm*—Guy W. Shoup; Leighton K. Chong

[57] ABSTRACT

An antenna terminal board device comprising an antenna board body and a cap engageable with the body, in which the terminal board body and the cap each are provided therein with a space, or a groove, for holding an antenna resistor and an antenna coil, respectively. The terminal board body is also provided with a partition wall which is adapted to be inserted in the groove provided in the cap and restrain movement of the antenna coil inserted therein, whereas the cap is also provided with a protruded portion which is adapted to abut on the antenna resistor inserted in the groove provided in the body to restrain movement of the resistor.

5 Claims, 4 Drawing Sheets

ANTENNA TERMINAL BOARD DEVICE FOR TUNER

BACKGROUND OF THE INVENTION

1. Field of the Invention

The present invention relates to an antenna terminal board device to be mounted to a UHF tuner and the like.

2. Description of the Prior Art

An example of the terminal board device so far been in use is illustrated in FIGS. 3 to 5, wherein FIG. 3 is an exploded perspective view showing the prior art antenna terminal device, FIG. 4 is an exploded perspective view showing the device before being mounted to a frame body, and FIG. 5 is a cross-sectional view of essential portion of the device mounted to the frame body.

In FIGS. 3 and 4, (31) denotes an antenna terminal body, (32) denotes an antenna pin embedded in the body (31), (33) denotes a coil mount provided on the body (31) perpendicularly thereto, which mount (33) is provided with a protruded portion (34), and an engagement groove (35) is provided on one side face of the body (31). Numeral reference (36) denotes an antenna coil, which is mounted on the mount (33) being wound around the protruded portion (34) with leads (37) at both ends thereof inserted in said antenna pins (32). An antenna resistor (39) is inserted in a holder (38), which is cylindrical and provided with a pulling hole (41) of a lead (40) at one end and an insertion hole (42) for the resistor (39) and a flange (43) at the other end. The antenna resistor (39) with one lead (40) bent is inserted in the holder (38) with the other lead (40) pulled out of the pulling hole (41), and the holder (38) is mounted on the body (31) with its flange (43) inserted in the engagement groove (35). The antenna terminal body (31) and the holder (38) constitute an antenna terminal board device. Incidentally, the other lead (40) of the antenna resistor (39) which has been bent is inserted in one antenna pin (32) together with a lead (37) of the antenna coil (36).

The antenna terminal board device integrally constructed as above is mounted to a frame body (44) of a UHF tuner as shown in FIG. 5, wherein (45) denotes an inductor which electrically couples with the antenna coil (36).

The antenna terminal board device of the prior art as above, however, has various disadvantages as follows:

(1) Since the antenna coil (36) is just turned around the protruded portion (34) of the coil mount (33), the same is liable to be deformed during the assembly work.

Even after the assembly work has been finished, since no means is provided for fixing the turned portion of the coil, the same is liable to get out of position producing a bad effect on the performance.

(2) Since there is provided nothing to protect the antenna coil (36), the same is required to be provided with double insulation in accordance with safety standards. As a result, the external diameter of the coil (36) becomes larger and its forming work becomes harder. Thus, an imperfectly formed coil (36) put on the protruded portion (34) of the mount (33) readily slips out of position.

(3) In the work to insert the antenna resistor (39) into the holder (38), it is necessary to pull out the lead (40) from the hole (41), but the hole (41) is so small that the productivity is kept low.

(4) In mounting the holder (38) to the body (31), the flange (43) of the holder (38) has to be laterally slided with reference to the body (31), which lowers the work efficiency.

(5) There also is a danger for the antenna resistor (39) to get out of the insertion hole (42) at the time the holder (38) is mounted to the body (31).

SUMMARY OF THE INVENTION

The present invention contemplates to overcome the above mentioned disadvantages in the prior art device. The primary object of the invention therefore is the provision of an antenna terminal board device that will not accompany such troubles during its assembly work as for the antenna coil to be deformed or get out of position and for the antenna resistor to slip out of position and such a device that will be readily assembled.

Another object of the invention is the provision of an antenna terminal board device wherein, after its assembly work has been finished, the antenna resistor and the antenna coil will not easily move but be securely fixed in place.

According to the invention, an antenna terminal board body and a cap are each provided with an empty space, or a groove, therein, and an antenna resistor and an antenna coil are adapted to be previously mounted in the respective empty spaces so as not to move therein, and therefore such troubles as for the antenna coil to be deformed or get out of position during the assembly work and for the antenna resistor to slip out in the middle of the assmbly work are eliminated. The mounting of the cap to the body is arranged to be performed by a quick-connect method and therefore productivity is greatly enhanced.

Since clearance grooves for leads of the antenna coil are provided in a partition wall on the body close to antenna pins and the leads, when the cap is mounted to the body, are adapted to be inserted in holes in the antenna pins along the clearance grooves guided thereby, the leads are smoothly inserted into the holes in the antenna pins without being deformed, and this also contributes to the enhancement of the productivity.

Since it is also arranged that the antenna resistor and the antenna coil in the empty spaces, or grooves, will, after the assembly work has been finished, be pressed by a protruded portion of the cap and the partition wall on the body, respectively, these members are securely fixed in place and not allowed to make any movement.

BRIEF DESCRIPTION OF THE DRAWINGS

FIGS. 1 and 2 show a preferred embodiment of the invention, wherein FIG. 1 is a cross-sectional view and FIG. 2 is an exploded perspective view.

FIGS. 3 to 5 show an example of the prior art device, wherein FIG. 3 is an exploded perspective view, FIG. 4 is an exploded perspective view of an antenna terminal board device before being mounted to a frame body, and FIG. 5 is a cross-sectional view of essential portion of the antenna terminal board device as mounted to the frame body.

DESCRIPTION OF THE PREFERRED EMBODIMENT

Figure 1:
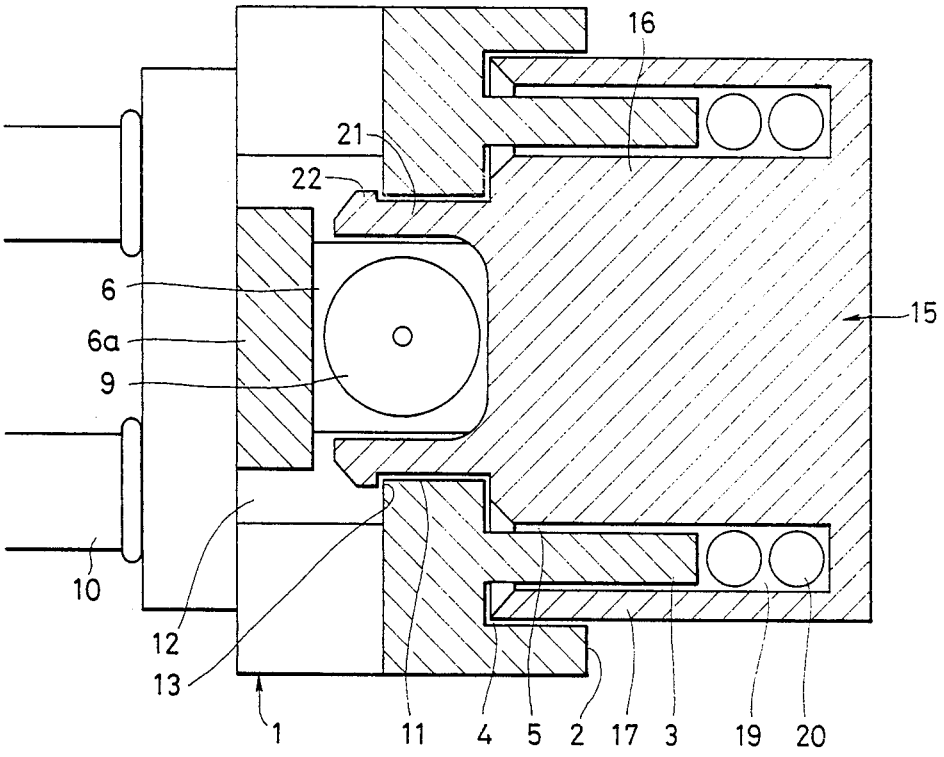
Figure 2:
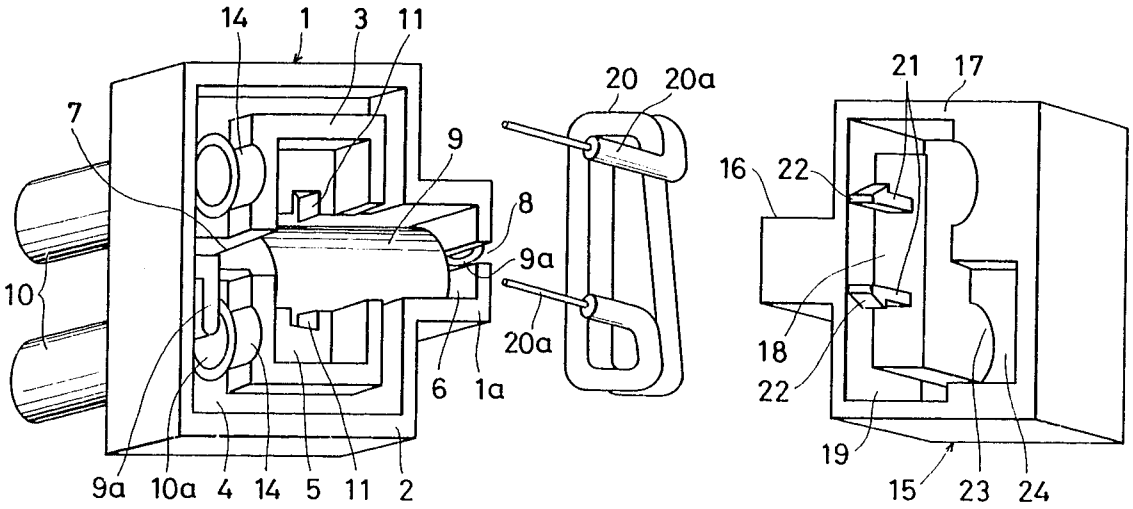
Figure 3:
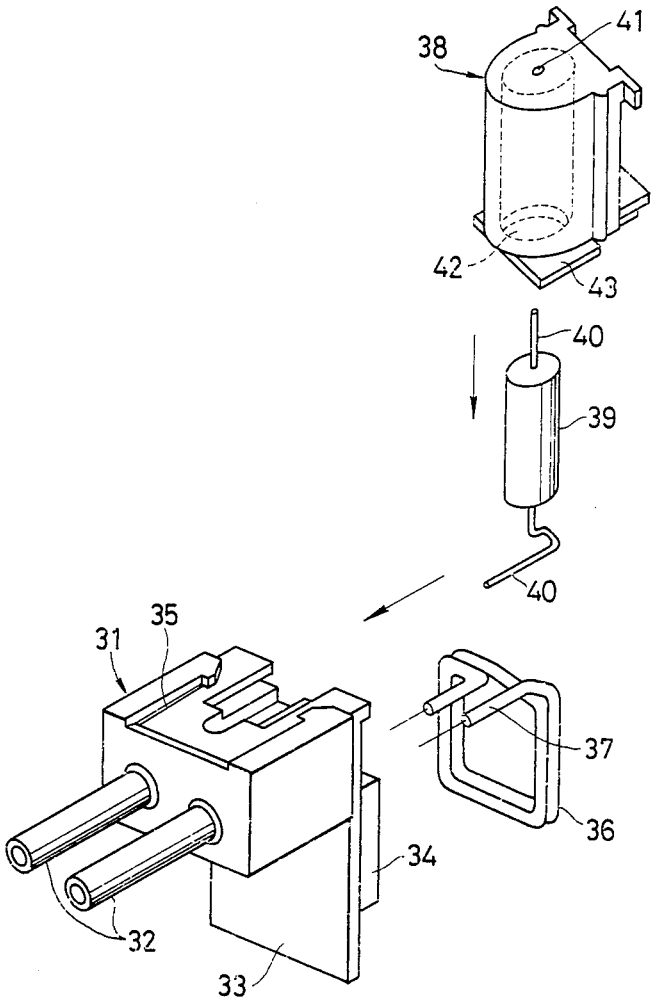
FIG. 3 PRIOR ART
Figure 4:
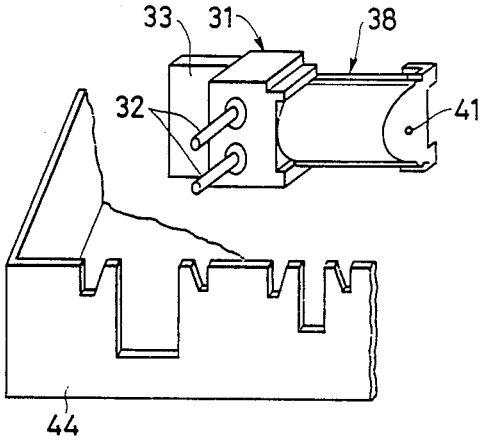
FIG. 4 PRIOR ART
Figure 5:
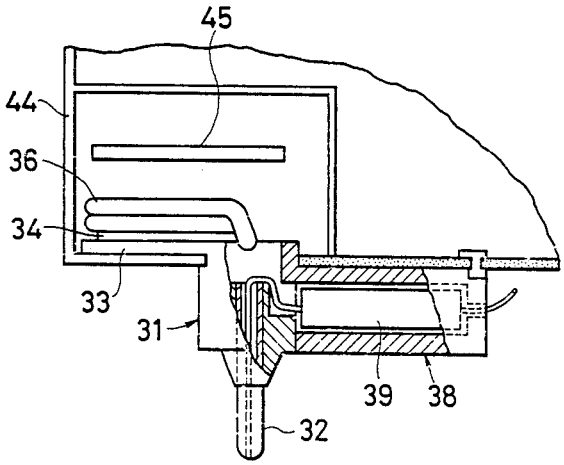
FIG. 5 PRIOR ART

FIGS. 1 and 2 show a preferred embodiment of the invention, wherein FIG. 1 is a cross-sectional view and FIG. 2 is an exploded perspective view.

Referring to the drawings, an antenna terminal board body (1) which is formed of a resin material is provided with a protruded portion (1*a*). Numeral reference (2) denotes a peripheral wall of the body (1), and (3) denotes a partition wall provided within the peripheral wall (2) integrally therewith, and a first groove (4) is formed between the peripheral wall (2) and the partition wall (3). Numeral reference (5) denotes a second groove which is surrounded by the partition wall (3) and formed to be substantially as deep as the first groove (4), and (6) denotes a third groove transversely cutting the first groove (4) and the second groove (5) and extending to the protruded portion (1*a*) of the body (1), and the third groove (6) is formed to be deeper than the first and second grooves (4), (5), with its one end projecting outwardly of the first groove (4) Numeral reference (7) denotes a cut groove provided by transversely cutting the partition wall (3) and in communication with the third groove (6) and the same is formed to be deeper than the first and second grooves (4), (5), but shallower than the third groove (6). Numeral reference (8) denotes a cut groove provided in the peripheral wall (2) of the.body (1) at the protruded portion (1*a*) and having a depth comparable to the cut groove (7), and (9) denotes an antenna resistor which is inserted in the third groove (6) with one lead (9*a*) thereof supported by the cut groove (8) in the peripheral wall (2) and the other lead (9*a*) thereof having been bent in three directions, the portion bent in the first direction supported by the cut groove (7) and the portion bent in the third direction inserted in a hole (1O*a*) in an antenna pin (10) which is erected on one side of the terminal board body (1). Numeral reference (11) denotes a pair of holes provided at the base portion of the partition wall (3) of the body (1), and (12) denotes a pair of holes provided in the bottom portion (6*a*) of the third groove (6) of the body (1). These holes (11) and (12) are communicating with each other and form corner portions (13) on the boundary between them, which corner portions (13) engage with engagement portions of mounting legs of a cap (15) to be described later. Numeral reference (14) denotes a recess portion provided in a portion of the partition wall (3) and close to the antenna pin (10), which recess portion (14) serves as a clearance groove for a lead of an antenna coil to be described later when the lead is inserted into the hole (10*a*) of the antenna pin (10).

Numeral reference (15) denotes a cap made of a resin material and provided at its one end with a protruded portion (16) which is fittable in the third groove (6) provided in the protruded portion (1*a*) of the body (1). Numeral reference (17) denotes a peripheral wall fittable in the first groove (4) provided between the peripheral wall (2) and the partition wall (3) of the body (1), and (18) denotes a protruded portion fittable in the second groove (5) provided within the partial wall (3) of the body (1), and between the peripheral wall (17) and the protruded portion (18) is formed an annular groove (19) in which the partition wall (3) of the body (1) is fittable. Numeral reference (20) denotes an antenna coil formed of a predetermined number of turns as shown in FIG. 1 with the leads (20*a*) at its ends pulled out in the direction perpendicular to the plane of the turn of the coil. The antenna coil (20) is fitted in the fourth groove (19) with its leads (20*a*) projecting outwardly to the open side. Numeral reference (21) denotes a mounting leg formed on the protruded portion (18) and is provided at its end with an engagement claw (22) engageable with the corner portion (13) formed on the peripheral wall of the body (1). Numeral reference (23) denotes a recess portion formed in the fourth groove (19) for guiding the lead (20*a*) of the antenna coil (20), and (24) denotes a recess portion formed in the peripheral wall (17) serving as a clearance groove for the lead (9*a*) of the antenna resistor (9) at the time the cap (15) is put on the body (1).

The assembling of the antenna terminal board device of the invention will be described below.

The antenna coil (20) is first fitted in the fourth groove (19) in the cap (15), when the leads (20*a*) of the coil (20) are positioned in the recess portions (23) in the peripheral wall (17). Then, the antenna resistor (9) is fitted in the third groove (6) in the body (1) with one lead (9*a*) thereof supported by the cut groove (8) in the peripheral wall (2) at the protruded portion (1*a*) and the end portion of the lead (9*a*) is drawn out of the cut frame body of the tuner. The other lead (9*a*) is supported by the cut groove (7) in the partition wall (3) and its end portion is inserted into the hole (10*a*) of one of the antenna pins (10). At this time, the outermost portion of the periphery of the antenna resistor (9) is positioned deeper than the bottom level of the first and second groove (4), (5) in the body (1).

Then, the peripheral wall (17) of the cap (15) is inserted into the first groove (4) in the body (1), the protruded portion (18) of the cap (15) inserted into the second groove (5), the protruded portion (16) of the cap (15) inserted in the third groove (6) in the protruded portion (1*a*) of the body (1), and the engagement claws (22) of the mounting legs (21) of the cap (15) are engaged with the corner portions (13) on the peripheral wall (2), and thus the mounting of the cap (15) to the body (1) is completed. At this time, the leads of the antenna coil (20) are inserted in the holes (10*a*) in the embedded antenna pins (10), and soldered with the antenna pins (10) and one lead (9*a*) of the antenna resistor (9) having been inserted in the hole (10*a*) of one of the antenna pins (10).

In such a state, the antenna coil (20) inserted in the fourth groove (19) in the cap (15) is fixed in place pressed by the partition wall (3) of the body (1), while the antenna resistor (9) inserted in the third groove (6) of the terminal board body (1) is secured in place pressed by the protruded portion (18) of the cap (15).

According to the embodiment of the invention as described above, various advantageous results are attained as follows:

(1) Since the assembling can be made only by fitting the cap (15) in the body (1) with the antenna coil (20) inserted in the fourth groove (19) of the cap (15), there is no deformation produced in the antenna coil (20) during the assembly work and therefore the productivity and performance of the product can be enhanced.

(2) Since the antenna coil (20) is inserted in the fourth groove (19) of the cap (15) and, further, the same is pressed by the partition wall (3) of the body (1) toward the bottom of the groove (19), movement of the antenna coil (20) is restrained; therefore, the relative positioning of the antenna coil (20) with reference to the inductor which is disposed on the rear side of the cap (15) can be made correctly and easily. The coil (20) also does not slip out during the assembly work. Since the coil (20) is restrained from movement, single insulation can satisfy safety standards.

(3) The antenna resistor (9) is simply installed by fitting the same in the third groove (6) in the body (1), and after the assembly work, the same is restrained from movement and held stable by means of the protruded portion (16) of the cap (15).

(4) Since the recess portions (23) provided in the fourth groove (19) of the cap (15) for guiding the leads (20*a*) of the coil (20) are running along the groove (19) toward the bottom arranged coaxially with the antenna pins (10) on the body (1), the coil (20) does not produce any deformation within the groove (19), and thus the insertion of the coil (20) into the groove (19) and that of the leads (20*a*) of the coil (20) into the holes (10*a*) of the antenna pins (10) can be smoothly carried out.

(5) Since the antenna resistor (9) as inserted in the third groove (6) in the body (1) is positioned deeper than the bottom levels of the first and second grooves (4), (5), and the same is pressed by the protruded portion (16) of the cap (15), there is no bloblems such as access of the resistor (9) to the antenna coil (20). Especially because the lead (9*a*) which is drawn out of the cut groove (8) of the peripheral wall (2) at the protruded portion (1*a*) of the body (1) is projecting away from the coiled portion of the antenna coil (20), approval by safety standards is assured.

(6) Since clearance grooves (14) for the leads (20*a*) of the antenna coil (20) are provided in the partition wall (3) of the body (1) close to the antenna pins (10), and, at the time the cap (15) is mounted to the body (1), the leads (20*a*) are adapted to be inserted in the holes (10*a*) of the antenna pins (10) guided along the clearance grooves (14), the leads (20*a*) can be smoothly inserted into the holes (10*a*) of the antenna pins (10) without being bent.

(7) Since the cap (15) is mounted to the body (1) by a quick-connect snap-in method the assembly work can be performed effectively.

Although, in the embodiment as described in the foregoing, the antenna resistor (9) was put in the body (1) and the antenna coil (20) was put in the cap (15), it can be reversely arranged, that is, the antenna coil (20) can be mounted to the body (1) and the antenna resistor (9) can be mounted to the cap (15). And the method for engagement of the cap (15) with the body (1) is not limited to the snap-in method as above, but, for example, engagement by means of a taper may be applicable.

What is claimed is:

1. An antenna terminal board construction comprising:

an antenna terminal board body having an external side and a peripheral wall defining a small interior space of said body for containing substantially only an antenna resistor therein, and a first groove defined in said interior space for mounting the antenna resistor in place in said interior space of said body;

a cap portion engageable with said peripheral wall of said antenna terminal board body for covering said interior space, said cap portion having a second groove formed therein for mounting substantially only an antenna coil therein, said second groove being disposed facing toward said interior space when said cap portion is engaged with said peripheral wall of said antenna terminal board;

wherein said antenna resistor is securely mounted in said first groove of said body and said antenna coil is securely mounted in said second groove of said cap portion, and both said components are securely held in place when said cap portion is engaged to said body.

2. An antenna terminal board construction according to claim 1, wherein said body is provided with a partition wall in said interior space which projects toward said cap portion so as to restrain movement of the antenna coil therein, and said cap portion is provided with a protruded portion which projects in said interior space of said body to restrain movement of said antenna resistor therein.

3. An antenna terminal board device as set forth in claim 1, wherein said terminal board body is provided with a partition wall which is inserted in the groove provided in said cap and the antenna coil inserted therein is adapted to be pressed by the partition wall toward the bottom of the groove.

4. An antenna terminal board device as set forth in claim 3, wherein said terminal board body is provided with antenna pins embedded therein each having an insertion hole therein and said partition wall is provided with clearance grooves for leads of the antenna coil close to the antenna pins, the leads of the antenna coil being inserted into the holes in the antenna pins guided along the clearance grooves.

5. An antenna terminal board device as set forth in claim 1, wherein said cap is provided with a protruded portion which abuts on the antenna resistor inserted in the groove in said terminal board body thereby to fix the same.

* * * * *